US007543396B2

(12) United States Patent
Nishino et al.

(10) Patent No.: US 7,543,396 B2
(45) Date of Patent: Jun. 9, 2009

(54) LAUNDRY APPARATUS

(75) Inventors: Masafumi Nishino, Osaka (JP); Kazushige Murakami, Osaka (JP); Mitsuru Naganawa, Osaka (JP)

(73) Assignees: Sanyo Electric Co., Ltd., Osaka (JP); Sanyo Electric Techno Create Co., Ltd., Osaka (JP)

( * ) Notice: Subject to any disclaimer, the term of this patent is extended or adjusted under 35 U.S.C. 154(b) by 0 days.

(21) Appl. No.: 11/984,371

(22) Filed: Nov. 16, 2007

(65) Prior Publication Data

US 2008/0115380 A1 May 22, 2008

(30) Foreign Application Priority Data

Nov. 21, 2006 (JP) ..... 2006-314579

(51) Int. Cl.
*F26B 11/02* (2006.01)

(52) U.S. Cl. ..... 34/606; 34/607; 34/231

(58) Field of Classification Search ..... 34/58, 34/595, 596, 604, 606, 607, 608, 134, 138, 34/218, 231
See application file for complete search history.

(56) References Cited

U.S. PATENT DOCUMENTS 3,722,106 A * 3/1973 Takeyama et al. ..... 34/604
6,954,995 B2 * 10/2005 Kitamura et al. ..... 34/597
7,421,865 B2 * 9/2008 Lee et al. ..... 68/15

FOREIGN PATENT DOCUMENTS

| | | |
|---|---|---|
| JP | 08-168595 | 7/1996 |
| JP | 2004-105250 | 4/2004 |
| JP | 2005-218881 | 8/2005 |

* cited by examiner

*Primary Examiner*—Jiping Lu
(74) *Attorney, Agent, or Firm*—Rabin & Berdo, PC

(57) ABSTRACT

A laundry apparatus according to the present invention ensures an improved laundry drying efficiency. In the laundry apparatus, an air guide (71) is provided on an upper edge portion of an outer tub opening (4*a*) as being opposed to an air inlet (6). Drying air flowing downward from the air inlet (6) to be supplied to the outer tub opening (4*a*) impinges on an inclined wall (72) of the air guide (71). The drying air impinging on the inclined wall (72) is deflected into a drum (5) through a drum opening (5*a*) (as indicated by a broken-line arrow). Thus, the drying air is prevented from further flowing downward in the outer tub opening (4*a*) into a gap (70) defined between the outer tub (4) and the drum (5), but supplied to laundry in the drum (5).

8 Claims, 5 Drawing Sheets

LAUNDRY APPARATUS

BACKGROUND OF THE INVENTION

1. Field of the Invention

The present invention relates to a laundry apparatus having a laundry drying function.

2. Description of Related Art

There are conventionally known laundry apparatuses which are capable of drying laundry contained in a drum thereof rotatable about a rotation axis (see, for example, JP-A1-2004-105250 (hereinafter referred to as Patent Document 1)). Such laundry apparatuses have been introduced in coin (or bill)-operated laundry shops, cleaning facilities, general households and the like.

A drum-type laundry cleaning/drying machine disclosed in Patent Document 1 includes a tub (outer tub) disposed in a housing thereof and having an opening formed in a front face thereof, and a drum disposed within the tub. The drum has an opening formed in a front face thereof in association with the opening of the tub. Laundry is loaded into the drum through the openings of the tub and the drum. The laundry contained in the drum is dried by applying drying air or hot air to the laundry while being agitated by rotation of the drum.

An air circulation duct through which the drying air flows extend as surrounding the tub, and its one end is connected to the opening of the tub in communication with the tub. The drying air supplied from the air circulation duct flows downward from the one end of the air circulation duct to be supplied to the laundry in the drum sequentially through the opening of the tub and the opening of the drum.

In the drum-type laundry cleaning/drying machine disclosed in Patent Document 1, the drying air supplied from the air circulation duct partly fails to reach the opening of the drum, and flows into a gap defined between the tub and the drum. Therefore, not all the drying air is supplied to the laundry in the drum. This may prevent improvement in laundry drying efficiency.

SUMMARY OF THE INVENTION

In view of the foregoing, it is an object of the present invention to provide a laundry apparatus which ensures an improved laundry drying efficiency.

A laundry apparatus according to the present invention comprises: an inner tub which is rotatable about a rotation axis extending generally horizontally and has an inner tub opening formed in one of opposite end faces thereof opposed along the rotation axis, the inner tub being configured to contain laundry loaded therein through the inner tub opening; an outer tub which accommodates the inner tub and has an outer tub opening provided in association with the inner tub opening; drying air generating unit which generates drying air for drying the laundry contained in the inner tub; drying air supply passage disposed above the outer tub opening as extending downward for causing the drying air generated by the drying air generating unit to flow downward and supplying the drying air to the outer tub opening; and air deflecting unit provided on an upper edge portion of the outer tub opening as being opposed to a lower end of the drying air supply passage for deflecting a flow of the drying air supplied to the outer tub opening to direct the drying air flow into the inner tub through the inner tub opening.

The air deflecting unit may include an inclined wall on which the drying air flowing downward impinges to be deflected into the inner tub.

The inclined wall may extend along an upper peripheral edge portion of the outer tub opening, and end walls may be respectively provided at longitudinally opposite ends of the inclined wall.

A divider wall may be provided on a longitudinally intermediate portion of the inclined wall for dividing the flow of the drying air deflected by the inclined wall.

The air deflecting unit may include an attachment member for attaching the air deflecting unit to the outer tub.

The attachment member may include screw insertion holes respectively provided in the divider wall and portions of the air deflecting unit longitudinally outward of the end walls.

The laundry apparatus may further comprise a door provided for opening and closing the outer tub opening, and a packing which seals a gap defined between the door and a peripheral edge of the outer tub opening when the door closes the outer tub opening, and the inclined wall may have an escape hole which permits the drying air to partly escape toward the packing.

The escape hole may be provided in a lower end portion of the inclined wall.

The door may have a translucent or transparent portion which covers the outer tub opening when the outer tub opening is closed by the door.

Alternatively, the air deflecting unit may comprise a door having an upper edge portion which is opposed to the lower end of the drying air supply passage when the outer tub opening is closed by the door, and deflects the flow of the drying air supplied to the outer tub opening to direct the drying air flow into the inner tub through the inner tub opening, and end walls provided on opposite sides of an area in which the upper edge portion of the door is opposed to the lower end of the drying air supply passage.

According to the present invention, the drying air generated by the drying air generating unit flows downward through the drying air supply passage to be supplied to the outer tub opening, and the flow of the drying air is deflected into the inner tub through the inner tub opening at the upper edge portion of the outer tub opening by the air deflecting unit. Thus, the drying air is prevented from further flowing downward into a gap defined between the outer tub and the inner tub. The drying air flowing downward is deflected into the inner side of the inner tub to be supplied to the laundry in the inner tub. Therefore, all the drying air is used for the drying of the laundry, thereby improving the laundry drying efficiency.

Since the air deflecting unit is provided on the upper edge portion of the outer tub opening, the air deflecting unit does not hinder the loading and unloading of the laundry in and out of the inner tub through the inner tub opening and the outer tub opening.

Further, the deflection of the drying air is achieved by a simple structure, i.e., by the inclined wall. The drying air flowing downward impinges on the inclined wall of the air deflecting unit to be deflected into the inner tub. Thus, the drying air is prevented from further flowing downward into the gap defined between the outer tub and the inner tub, but reliably supplied to the laundry in the inner tub. This ensures an improved laundry drying efficiency.

Further, the drying air is smoothly guided into the inner tub from the upper edge portion of the outer tub opening. The drying air having impinged on the inclined wall partly flows longitudinally of the inclined wall, but impinges on the end walls provided on the longitudinally opposite ends of the inclined wall. Thus, the drying air is prevented from further flowing longitudinally of the inclined wall, but reliably supplied into the inner tub. This ensures an improved laundry drying efficiency.

The flow of the drying air deflected by the inclined wall is divided by the divider wall provided on the longitudinally intermediate portion of the inclined wall. Without the provision of the divider wall, the drying air having impinged on the inclined wall flows to the longitudinally opposite ends of the inclined wall to be supplied into the inner tub. That is, the drying air is supplied into the inner tub from local positions of the inclined wall and, therefore, unevenly applied to the laundry, making it impossible to improve the laundry drying efficiency. With the provision of the divider wall, on the contrary, the flow of the drying air on the inclined wall is divided by the divider wall. Therefore, the drying air is not concentrated on the local positions of the inclined wall, but evenly applied to the laundry in the inner tub from the inclined wall. This further improves the laundry drying efficiency.

Since the air deflecting unit includes the attachment member for the attachment thereof to the outer tub, the number of the components is reduced without the need for providing an additional attachment member for attaching the air deflecting unit to the outer tub.

The attachment member includes the screw insertion holes respectively provided in the divider wall and the portions of the air deflecting unit longitudinally outward of the end walls. Therefore, the air deflecting unit can be attached to the outer tub by inserting screws through the respective screw insertion holes and fixing the screws to the outer tub. Further, a plurality of joint portions are thus provided between the outer tub and the air deflecting unit, so that the attitude of the air deflecting unit attached to the outer tub can be stabilized.

The inclined wall has the escape hole which permits the drying air to partly escape toward the packing. If the packing is wet when the laundry is unloaded from the inner tub through the outer tub opening with the door being opened after completion of the drying of the laundry, the dried laundry will be wetted in contact with the wet packing. Further, if the packing is wetted with a cleaning solvent, a part of the dried laundry in contact with the packing is liable to thermally react with the solvent to be thereby discolored. With the provision of the escape hole, however, the drying air impinging on the inclined wall partly escapes toward the packing through the escape hole, so that the packing is dried by the escaping drying air. Therefore, the laundry is free from the wetting, the discoloration and other inconveniences even if the laundry is brought into contact with the packing when the laundry is unloaded after the completion of the drying.

As described above, the drying air flowing downward through the drying air supply passage impinges on the inclined wall of the air deflecting unit to be thereby prevented from impinging on the door. This prevents the door from being needlessly overheated.

The escape hole is provided in the lower end portion of the inclined wall. A portion of the packing located below the outer tub opening is located apart from the drying air impinging on the inclined wall on the upper edge portion of the outer tub opening. However, the drying air is partly supplied to the portion of the packing located below the outer tub opening through the escape hole formed in the lower end portion of the inclined wall, so that this portion of the packing is prevented from being wetted. Thus, the packing is completely dried, so that the laundry is completely free from the wetting, the discoloration and other inconveniences even if the laundry is brought into contact with the packing when the laundry is unloaded after the completion of the drying.

The portion of the door which covers the outer tub opening when the outer tub opening is closed is translucent or transparent. Therefore, the laundry apparatus is convenient in that the laundry contained in the inner tub can be observed through the door. As described above, the air deflecting unit is disposed on the upper edge portion of the outer tub opening and, therefore, does not hinder the observation.

The drying air generated by the drying air generating unit flows downward through the drying air supply passage to be supplied to the outer tub opening, and impinges on the upper edge portion of the door opposed to the lower end of the drying air supply passage. At this time, the drying air is deflected into the inner tub through the inner tub opening by the upper edge portion of the door. Thus, the drying air is prevented from further flowing downward in the outer tub opening into the gap defined between the outer tub and the inner tub. The drying air flowing downward is deflected into the inner side of the inner tub to be supplied to the laundry in the inner tub. Therefore, all the drying air is used for the drying of the laundry, thereby improving the laundry drying efficiency.

The drying air having impinged on the upper edge portion of the door partly flows along the outer periphery of the door including the upper edge portion, but impinges on the end walls disposed on the opposite sides of the area in which the upper edge portion of the door is opposed to the lower end of the drying air supply passage. Thus, the drying air is prevented from further flowing along the outer periphery of the door, but reliably supplied into the inner tub. This ensures an improved laundry drying efficiency.

The foregoing and other objects, features and effects of the present invention will become more apparent from the following detailed description of the preferred embodiments with reference to the attached drawings.

DETAILED DESCRIPTION OF PREFERRED EMBODIMENTS

External Construction of Dry Cleaner

Figure 1:
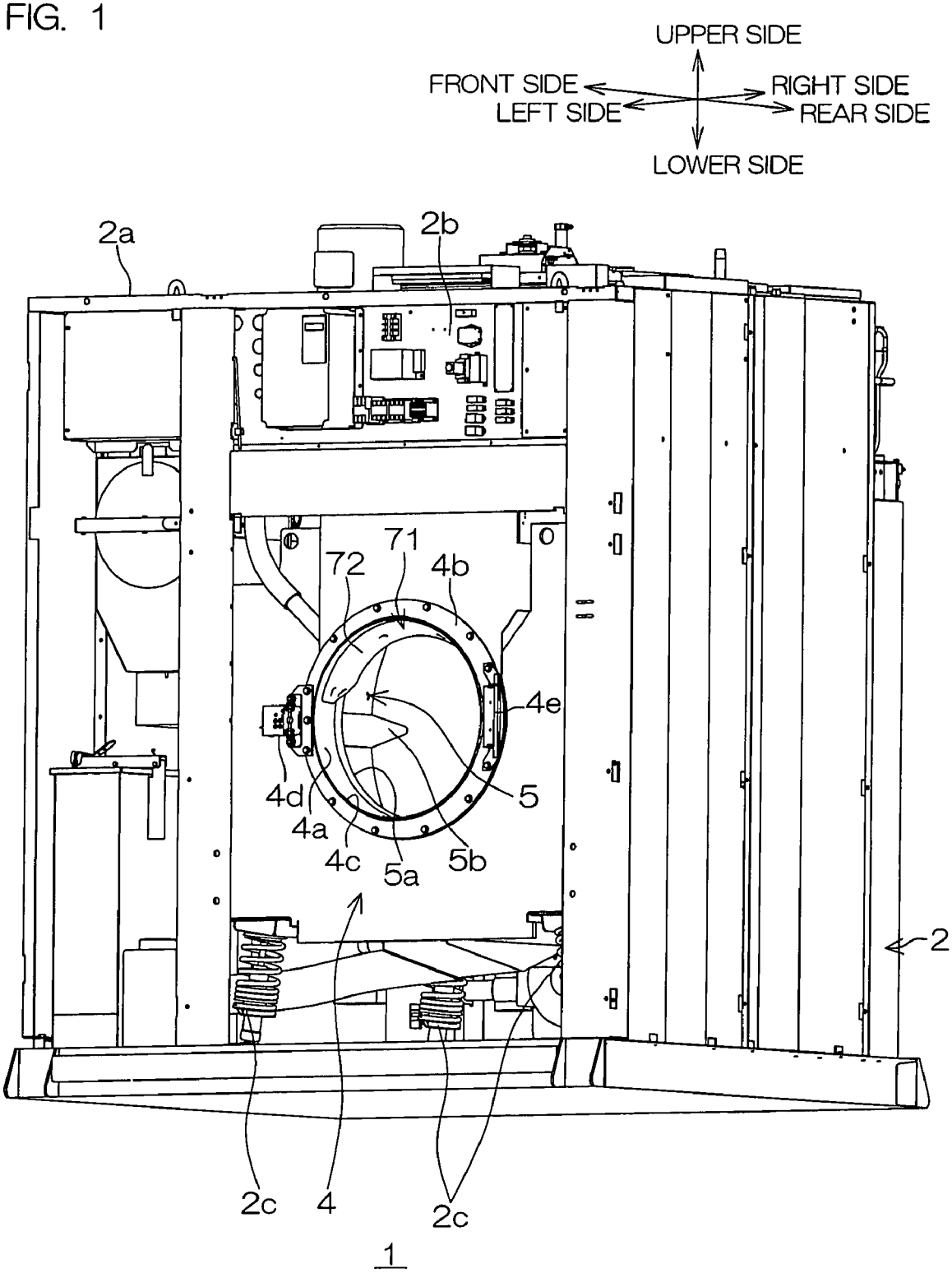
FIG. 1 is a front perspective view of major portions of a dry cleaner 1 as a laundry apparatus according to one embodiment of the present invention.

FIG. 1 is a front perspective view of major portions of a dry cleaner 1 as a laundry apparatus according to one embodiment of the present invention. Reference will be made to directional arrows shown in FIG. 1 for directional notation (this holds true for the other figures).

Figure 2:
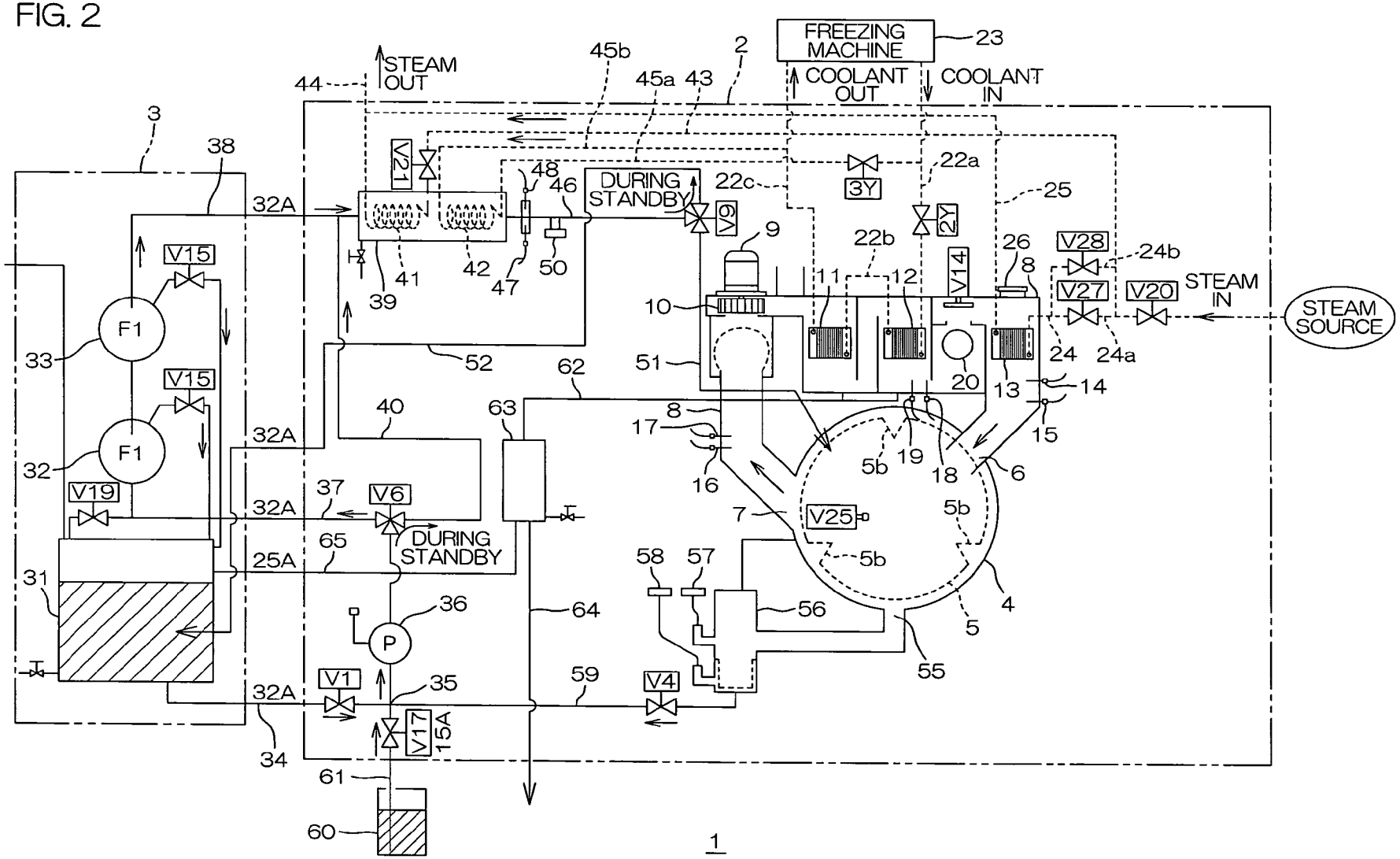
FIG. 2 is a pipeline diagram of the dry cleaner 1.

Referring to FIG. 1, the dry cleaner 1 is, for example, for business use, and includes a generally rectangular box-shaped main body 2, and a tank/filter kit 3 (see FIG. 2).

The main body 2 includes a rack-like frame 2*a*. An outer tub 4 and a drum 5 (inner tub) accommodated in the outer tub 4 are provided within the frame 2*a*. The frame 2*a* is fixed to a floor. An operation panel 2*b* is attached to a front face portion of the frame 2*a* above the outer tub 4, specifically, at around a level of user's eyes. A user operates operation buttons (not shown) of the operation panel 2*b* to cause the dry cleaner 1 to perform desired operations, and the operation status of the dry cleaner 1 is displayed on a display panel (not shown) of the operation panel 2*b*.

The outer tub 4 is of a generally rectangular box shape, and has a generally cylindrical space defined therein. The outer tub 4 has an outer tub opening 4*a* formed in a front wall thereof as communicating with the inside thereof and having a round shape as seen from the front side. An annular metal rim 4*b* is fitted along the periphery of the outer tub opening 4*a*. An annular packing 4*c* is attached to an inner peripheral front edge of the rim 4*b*. The rim 4*b* has a hinge 4*d* provided at a left edge portion thereof, and an engagement projection 4*e* provided at a right edge portion thereof. A door 4*f* (see FIG. 3) is attached to the hinge 4*d* so as to be pivotal about a pivot shaft of the hinge 4*d* to open and close the outer tub opening 4*a*. The door 4*f* has an engagement projection (not shown) provided at a portion thereof opposite from the hinge side. When the door 4*f* closes the outer tub opening 4*a*, the engagement projection (not shown) of the door 4*f* is engaged with the engagement projection 4*e* of the rim 4*b*, whereby the door 4*f* is locked with the outer tub opening 4*a* closed.

Four corners of a bottom face of the outer tub 4 are connected to the frame 2*a* via dampers 2*c*. Therefore, even if the outer tub 4 vibrates during the operation of the dry cleaner 1, the vibrations of the outer tub 4 are damped by the dampers 2*c* and hence prevented from being propagated around the dry cleaner 1 through the frame 2*a*.

The drum 5 has a generally cylindrical hollow shape, and is disposed with its center shaft extending generally horizontally, specifically, extending anteroposteriorly. The drum 5 is rotatable about the center shaft. The drum 5 has a drum opening 5*a* (inner tub opening) formed in a front wall thereof at a position corresponding to the outer tub opening 4*a* as communicating with the inside of the drum 5. The drum opening 5*a* is anteroposteriorly opposed to the outer tub opening 4*a*. Therefore, laundry can be loaded into the drum 5 through the outer tub opening 4*a* and the drum opening 5*a* with the door 4*f* (see FIG. 3) being opened. A plurality of baffles 5*b* are provided on an inner peripheral surface of the drum 5 as projecting toward the center shaft.

Internal Construction of Dry Cleaner

FIG. 2 is a pipeline diagram of the dry cleaner 1. With reference to FIG. 2, the internal construction of the dry cleaner 1 will hereinafter be described in detail.

The outer tub 4 has an air inlet 6 through which air is introduced into the drum 5, and an air outlet 7 through which the air is expelled from the drum 5. The air outlet 7 and the air inlet 6 are connected to each other through a circulation duct 8 (drying air supply passage). That is, the circulation duct 8 is a closed circuit which connects the air outlet 7 and the air inlet 6.

The dry cleaner 1 is an apparatus designed to perform a dry cleaning process with the use of a special solvent such as a petroleum-based solvent or a silicone-based solvent (the silicone-based solvent is used in this embodiment). The dry cleaning process is advantageous in that laundry is less liable to shrink and oil stains are more easily removed as compared with a water cleaning process in which the laundry is washed with water. On the other hand, it is not desirable to release the solvent used for the dry cleaning to the external environment. Therefore, the dry cleaner according to this embodiment is of a type which is adapted to recover all the used solvent.

More specifically, a predetermined amount of solvent supplied from a tank 31 to be described later is contained in the outer tub 4, and the laundry is washed with the solvent in a washing process. After the washing process, the solvent is recovered from the outer tub 4 into the tank 31. Further, the drum 5 is rotated at a higher speed to remove residual solvent from the laundry. The removed solvent is also recovered into the tank 31. Thereafter, a drying process is performed to dry the laundry by circulating the air between the circulation duct 8 and the drum 5 while rotating the drum 5 at a lower speed. The vapor of the solvent resulting from vaporization of the solvent from the laundry in the drying process is also recovered by condensation thereof. During the rotation of the drum 5, the laundry is agitated by the baffles 5*b*. Thus, the laundry is efficiently washed and dried.

In the drying process, a blower 10 is rotated by a blower motor 9, whereby the air in the drum 5 is circulated from the air outlet 7 into the air inlet 6 through the circulation duct 8. Drying coolers 11 and 12 are provided in the circulation duct 8, and a drying heater 13 (drying air generating unit) is provided adjacent the air inlet 6. The air flowing out of the drum 5 into the circulation duct 8 through the air outlet 7 contains the vaporized solvent (solvent gas). The air containing the solvent gas is cooled by the drying coolers 11 and 12, so that the solvent gas in the air is liquefied. That is, the solvent-containing air flowing through the circulation duct 8 is cooled by the drying coolers 11 and 12, whereby the solvent is condensed and recovered from the air. Thereafter, the air is heated by the drying heater 13, and the heated air is supplied as drying air into the drum 5 through the air inlet 6. In the drum 5, the heated air is heat-exchanged with the laundry, whereby the solvent contained in the laundry is vaporized. The vaporized solvent flows together with the air into the circulation duct 8 through the air outlet 7. This cycle in which the air in the drum 5 is circulated between the drum 5 and the circulation duct 8 is repeated, thereby drying the laundry in the drum 5. As will be described later, the dry cleaner 1 is configured such that the drying air from the air inlet 6 is supplied to the laundry in the drum 5 through the outer tub opening 4*a* and the drum opening 5*a*. The drum opening 5*a* is an opening having the greatest size in the drum 5, so that the drying air can be efficiently supplied to the laundry through the drum opening 5*a*.

Meanwhile, the solvent is flammable. Therefore, there is the danger of ignition or explosion of the vaporized solvent unless the temperature of the heated air is reliably controlled in the drying process.

For detecting the temperature of the heated air supplied into the drum 5 from the air inlet 6, a drum inlet temperature thermistor 14 and an inlet over-temperature preventing thermistor 15 are provided downstream of the drying heater 13 (on a downstream side with respect to an air flow direction—this definition holds true for the following description) in the circulation duct 8. Though not shown, the inlet over-temperature preventing thermistor 15 is connected to a transistor circuit, and configured such that the circuit is cut off through the transistor, for example, when a temperature of 95° C. is detected. Therefore, the inlet over-temperature preventing thermistor 15 is advantageous in that it ensures more accurate detection of an operation temperature and a quicker response to the temperature than a thermostat.

For detecting the temperature of the air expelled from the air outlet 7, a drum outlet temperature thermistor 16 and an abnormal outlet temperature judging thermistor 17 which monitors the drum outlet temperature thermistor 16 to check whether or not the drum outlet temperature thermistor 16 malfunctions are provided in the circulation duct 8. For detecting the temperature of the air cooled by a downstream one of the two drying coolers 11 and 12, a cooler temperature thermistor 18 and a cooler over-temperature preventing thermistor 19 which constitutes a part of a safety circuit are provided in the circulation duct 8.

Further, an aspiration port 20 and a gate valve V14 are provided between the drying cooler 12 and the drying heater 13 in the circulation duct 8 for regulating the internal pressure of the circulation duct 8 when the circulation duct internal pressure is excessively increased. Normally, the aspiration port 20 is opened, and the gate valve V14 is opened to permit the air to flow through the circulation duct 8. Further, the circulation duct 8 has an explosion protection port 26 which, if the solvent gas-containing air flowing through the circulation duct 8 happens to be ignited to cause explosion, releases the blast of the explosion. The explosion protection port 26 is biased in a closing direction by a spring not shown.

The drying coolers 11 and 12 are connected to a freezing machine 23 through coolant passages 22*a*, 22*b* and 22*c*. The freezing machine 23 is disposed outside the main body 2. When a drying cooler electromagnetic valve 2Y inserted in the coolant passage 22*a* is opened, a coolant (e.g., cooling water) flows from the freezing machine 23 into the drying cooler 12 and the drying cooler 11 through the coolant passages 22*a* and 22*b*, whereby the drying cooler 12 and the drying cooler 11 perform a cooling operation. The drying coolers 11 and 12 are herein connected in series with each other to the freezing machine 23, but may be connected in parallel with each other to the freezing machine 23. More specifically, the coolant passages 22*a* and 22*c* may be provided for each of the drying coolers 11 and 12 to supply the coolant individually to the drying coolers 11 and 12 from the freezing machine 23. Of course, freezing machines 23 may be respectively provided for the drying coolers 11 and 12.

Steam passages 24 and 25 are connected to the drying heater 13. More specifically, the steam passage 24 connects an external steam source to the drying heater 13. An inlet valve V20 is inserted in the steam passage 24. The steam passage 24 is branched into a first steam supply passage 24*a* having a relatively great passage diameter and a second steam supply passage 24*b* having a relatively small passage diameter between the drying heater 13 and the inlet valve V20. A first valve V27 is inserted in the first steam supply passage 24*a*, and a second valve V28 is inserted in the second steam supply passage 24*b*. On the other hand, the steam passage 25 is a passage through which the steam supplied from the steam passage 24 to the drying heater 13 is expelled to the outside.

With the inlet valve V20 and the first valve v27 and/or the second valve V28 being opened, steam (e.g., steam at 110 to 120° C.) is supplied to the drying heater 13, whereby the drying heater 13 performs a heating operation. Since the first steam supply passage 24*a* and the second steam supply passage 24*b* are different in steam supply capacity, the steam may be supplied to the drying heater 13 from one or both of the first steam supply passage 24*a* and the second steam supply passage 24*b* as required.

In the drying process, the rotation of the blower motor 9, and the opening and closing of the inlet valve V20 and the first valve V27 and/or the second valve V28 are typically controlled based on temperatures detected by the drum inlet temperature thermistor 14, the drum outlet temperature thermistor 16 and the cooler temperature thermistor 18.

The tank/filter kit 3 includes the tank 31 which stores the solvent, and a first filter 32 and a second filter 33 which are connected in series for filtering the solvent pumped up from the tank 31. A pump-up pipe 34 is connected to a bottom of the tank 31 at one end thereof. A valve V1 is inserted in the pump-up pipe 34. The other end of the pump-up pipe 34 is connected to a junction 35. A solvent pump 36 is connected to the junction 35 on its suction side and to an inlet of a three-way valve V6 on its ejection side. One outlet of the three-way valve V6 is connected to one end of a flow pipe 37, and the other end of the flow pipe 37 is connected to the tank 31 via a valve V19. The flow pipe 37 is branched at its intermediate portion (between the three-way valve V6 and the valve V19) to be connected to the serial connection of the first filter 32 and the second filter 33. A flow pipe 38 is connected to an outlet of the second filter 33, and a distal end of the flow pipe 38 is connected to an inlet of a solvent heat exchanger 39 provided in the main body 2.

A bypass pipe 40 is connected to the other outlet of the three-way valve V6 at one end thereof, and the other end of the bypass pipe 40 joins the flow pipe 38 connected to the inlet of the solvent heat exchanger 39.

Therefore, the solvent is applied to the solvent heat exchanger 39 through the first filter 32 and the second filter 33, or applied to the solvent heat exchanger 39 through the bypass pipe 40 with the filters 32 and 33 bypassed by switching between the outlets of the three-way valve V6.

A steam pipe 41 and a coolant pipe 42 are provided in the solvent heat exchanger 39. The steam pipe 41 and the coolant pipe 42 are each wound, for example, in a coil shape. Steam passages 43 and 44 are connected to the steam pipe 41. The steam passage 43 connects the steam pipe 41 and the steam passage 24, and a valve V21 is inserted in the steam passage 43. On the other hand, the steam passage 44 is a passage through which the steam supplied from the steam passage 43 to the steam pipe 41 is discharged to the outside. With the valve V21 being opened, the steam flows into the steam pipe 41 through the steam passage 43 to be discharged through the steam passage 44. While the solvent passes through the solvent heat exchanger 39, the steam pipe 41 at a high temperature exchanges heat with the solvent to heat the solvent. On the other hand, coolant passages 45*a* and 45*b* are connected to the coolant pipe 42, and a solvent cooler electromagnetic valve 3Y is inserted in the coolant passage 45*a*. With the solvent cooler electromagnetic valve 3Y being opened, the coolant passes through the coolant pipe 42. While the solvent passes through the solvent heat exchanger 39, the coolant pipe 42 exchanges heat with the solvent to cool the solvent. By controlling the opening and closing of the valve V21 and the opening and closing of the solvent cooler electromagnetic valve 3Y, the solvent heat exchanger 39 is switched to heat or cool the solvent, whereby the temperature of the solvent passing through the solvent heat exchanger 39 is regulated at a desired temperature level.

A flow pipe 46 is connected to an outlet of the solvent heat exchanger 39 at one end thereof. The other end of the flow pipe 46 is connected to an inlet of a three-way valve V9. A liquid temperature thermistor 47 for measuring the temperature of the solvent and a liquid over-temperature preventing thermistor 48 for preventing a liquid temperature from being increased to a predetermined temperature level or higher are provided in the flow pipe 46.

A soap concentration sensor 50 is provided downstream of these two thermistors in the flow pipe 46.

A liquid supply pipe 51 is connected to one outlet of the three-way valve V9 at one end thereof and to the outer tub 4 at the other end thereof, so that the solvent can be supplied into the drum 5. A feedback pipe 52 is connected to the other outlet of the three-way valve V9 at one end thereof and to the tank 31 at the other end thereof.

A recovery pipe 62 for recovering the solvent condensed by the drying coolers 11 and 12 in the circulation duct 8 has one end connected to a portion of the circulation duct 8 below the drying coolers 11 and 12. The other end of the recovery pipe 62 is connected to a water separator 63. In the water separator 63, water contained in the recovered solvent is separated, and the separated water is drained through a drain pipe 64. Then, the recovered solvent is returned into the tank 31 through a recovery pipe 65.

The outer tub 4 has a drain port 55 provided at its lowermost portion, and a liquid surface detection chamber 56 is connected to the drain port 55. The liquid surface detection chamber 56 is provided with two liquid surface switches, i.e., a standard liquid surface switch 57 and a drain liquid surface switch 58. The liquid surface detection chamber 56 also serves as a trap which traps a button or the like dislodged from the laundry and falling through the drain port 55 during the washing process.

A recovery pipe 59 is connected to a lower end of the liquid surface detection chamber 56 at one end thereof. A valve V4 is inserted in the recovery pipe 59. The other end of the recovery pipe 59 is connected to the junction 35.

A soap pipe 61 is connected to a soap container 60 at one end thereof and to the junction 35 at the other end thereof. A valve V17 is inserted in the soap pipe 61.

Next, the flow of the solvent will be described with reference to the pipeline diagram shown in FIG. 2.

In the washing process, the solvent stored in the tank 31 is supplied into the drum 5 (the outer tub 4). At this time, the solvent pump 36 is driven with the valve V1 being opened, with the three-way valve V6 being opened to the flow pipe 37 and with the valve V19 being closed. Thus, the solvent in the tank 31 flows into the flow pipe 38 through the first filter 32 and the second filter 33 and, after the temperature of the solvent is regulated by the solvent heat exchanger 39, the solvent flows to the three-way valve V9 through the flow pipe 46. With the three-way valve V9 being opened to the liquid supply pipe 51, the solvent is supplied into the outer tub 4 through the liquid supply pipe 51. During the supply of the solvent, the valve V4 is closed. The amount of the solvent contained in the outer tub 4 is detected by the standard liquid surface switch 57 and, when a predetermined amount of the solvent (suitable for the washing) is contained in the outer tub 4, the valve V9 is switched so as to close the liquid supply pipe 51 and open the feedback pipe 52.

A soap is preliminarily mixed with the solvent contained in the tank 31 and, when the solvent passes through the flow pipe 46, the concentration of the soap in the solvent is measured by the soap concentration sensor 50. If the soap concentration is lower, the soap is pumped up from the soap container 60 through the soap pipe 61 with the valve V17 being opened, and mixed with the supplied solvent.

During the supply of the solvent to the outer tub 4, the three-way valve V6 may be switched, as required, to cause the solvent to bypass the filters 32, 33, so that the solvent is applied to the solvent heat exchanger 39 through the bypass pipe 40 and then supplied to the outer tub 4.

In a solvent draining and removing process, the solvent pump 36 is driven with the valve V4 being opened and with the valve V1 being closed. The solvent is returned into the tank 31 with the three-way valve V6 being opened to the flow pipe 37 and with the valve V19 being opened.

Alternatively, the solvent flowing through the flow pipe 37 may be caused to flow through the filters 32 and 33, the flow pipe 38, the solvent heat exchanger 39 and the flow pipe 46 with the valve V19 being closed, and then flow through the three-way valve V9 and the feedback pipe 52 back into the tank 31. Thus, the solvent drained from the outer tub 4 after the washing process and the solvent removed from the laundry by the centrifugal force are passed through the filters 32 and 33 for decontamination, and then returned into the tank 31.

Air Guide

Figure 3:
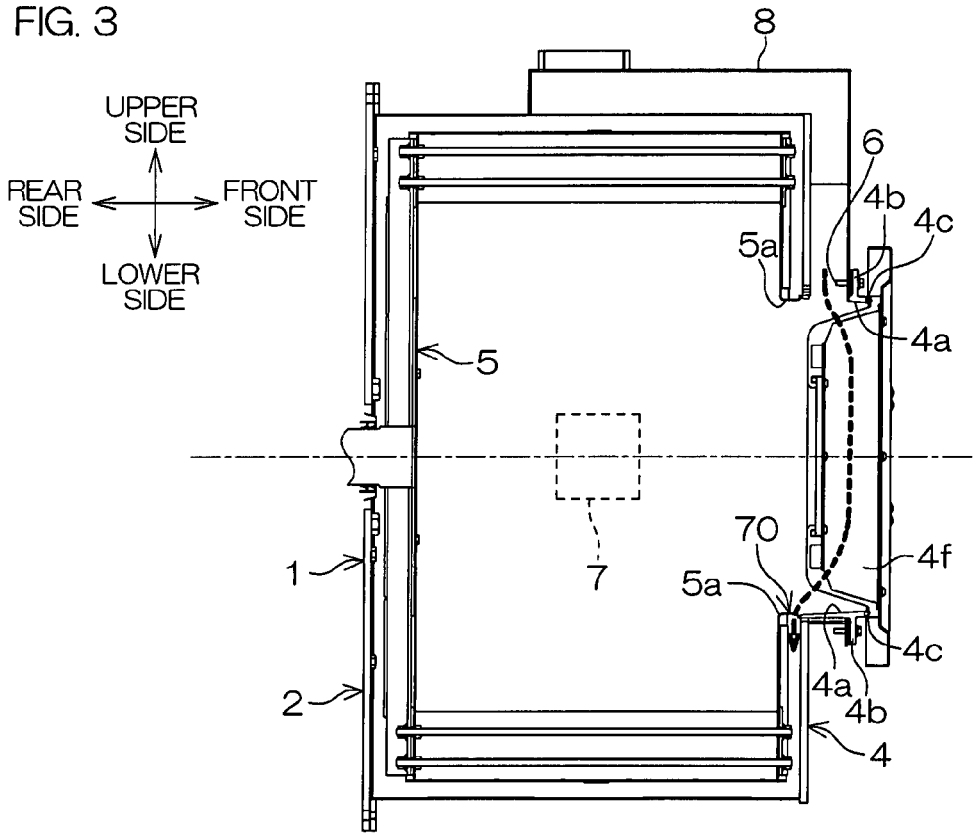
FIG. 3 is a side sectional view of a main body 2 of the dry cleaner 1 without provision of an air guide 71.
Figure 4:
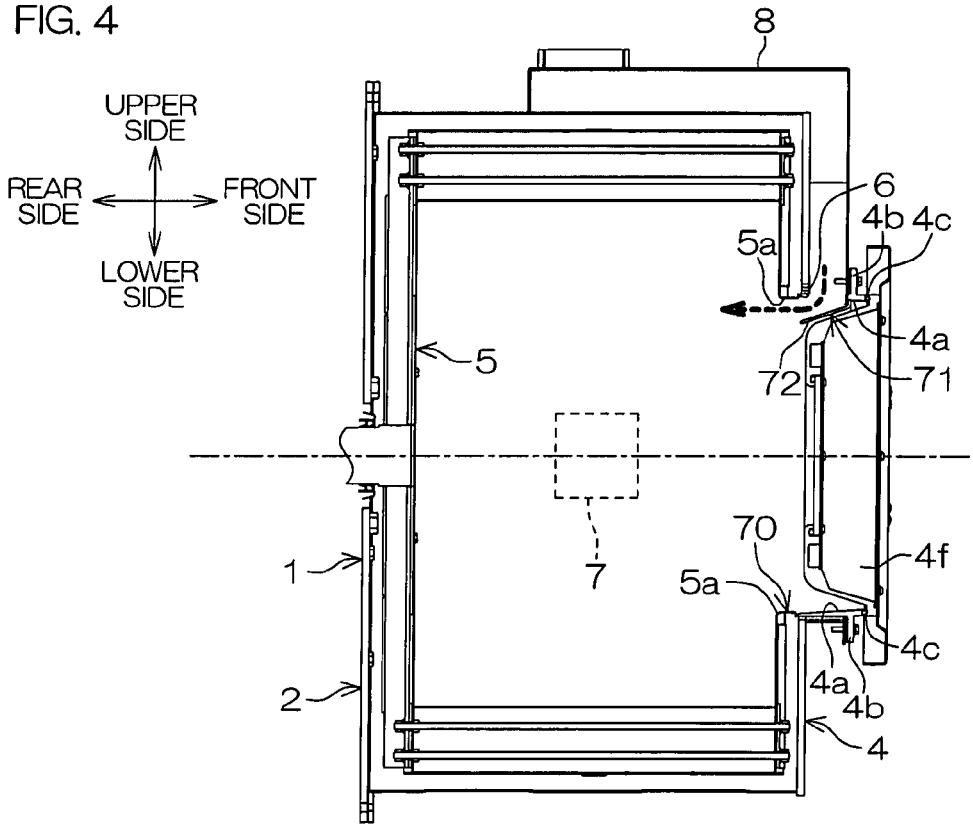
FIG. 4 is a side sectional view of the main body 2 of the dry cleaner 1 with the provision of the air guide 71.
Figure 5:
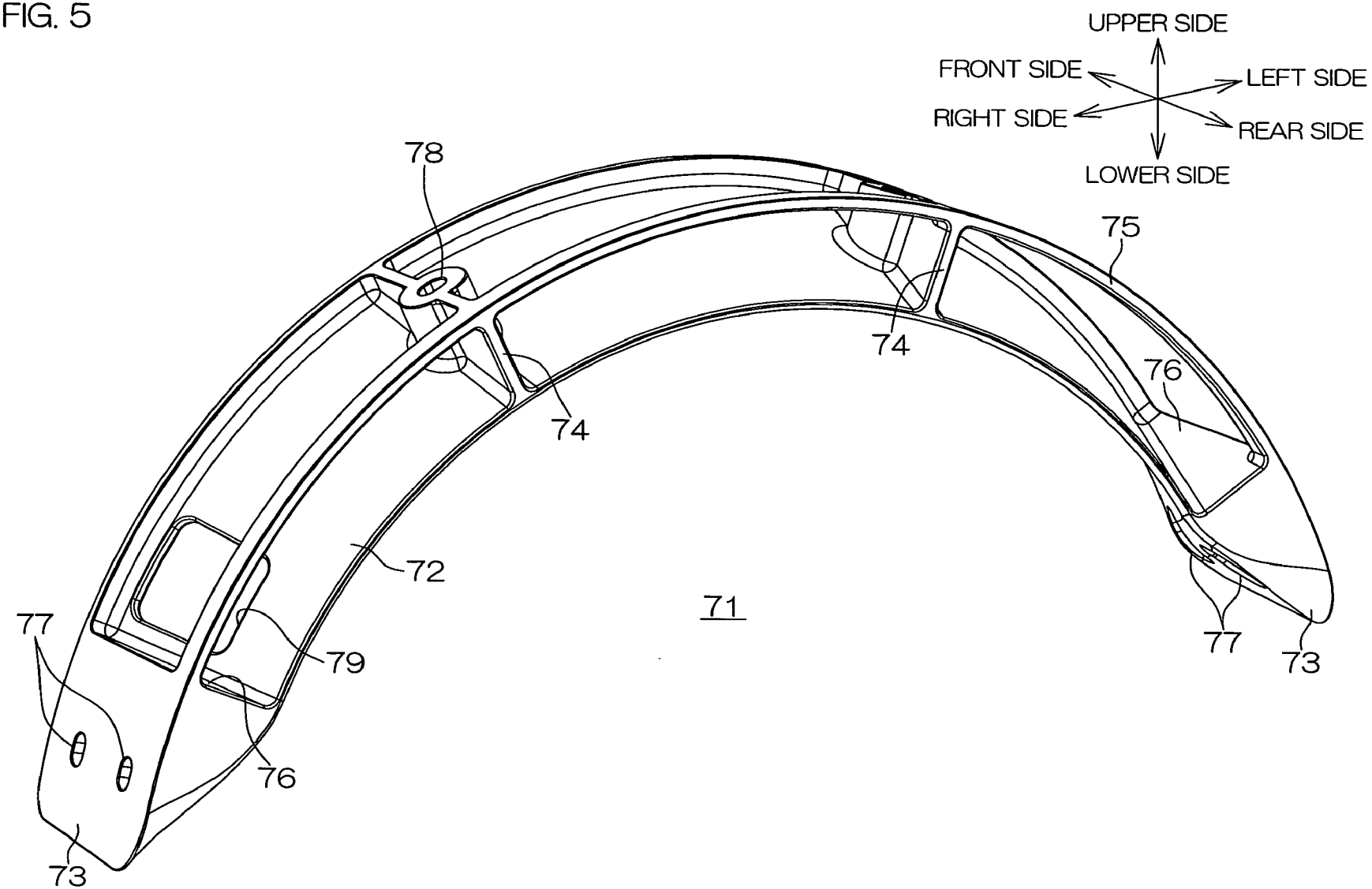
FIG. 5 is a rear perspective view of the air guide 71.
Figure 6:
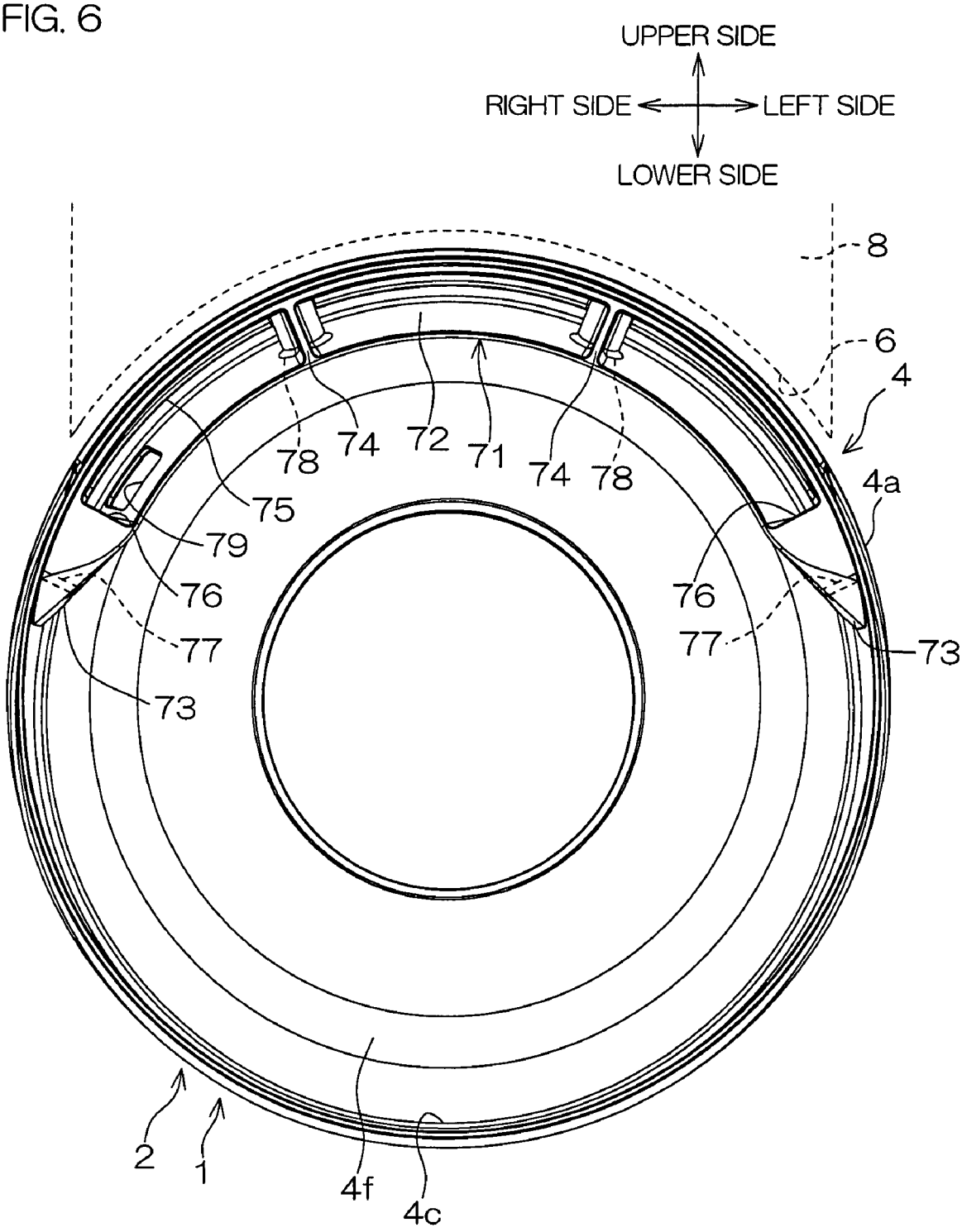
FIG. 6 illustrates a peripheral portion of an outer tub opening 4*a* closed by a door 4*f* as seen from the inside of the drum 5.

FIG. 3 is a side sectional view of the main body 2 of the dry cleaner 1 without provision of an air guide 71. FIG. 4 is a side sectional view of the main body 2 of the dry cleaner 1 with the provision of the air guide 71. FIG. 5 is a rear perspective view of the air guide 71. FIG. 6 illustrates a peripheral portion of the outer tub opening 4*a* closed by the door 4*f* as seen from the inside of the drum 5.

As shown in FIG. 3, the aforesaid circulation duct 8 extends forward along an upper wall of the outer tub 4 to be bent at a front edge of the upper wall of the outer tub 4, and further extends downward along a front wall of the outer tub 4 above the outer tub opening 4*a*. The air inlet 6 is located at a lower end of the circulation duct 8, and connected to an upper edge portion of the outer tub opening 4*a* to be directed downward. More specifically, the air inlet 6 has an arcuate shape as seen from the front side and a generally rectangular shape as seen from the bottom side (see FIG. 6). In the aforesaid drying process, the drying air flows downward from the air inlet 6 to be supplied to the outer tub opening 4*a*. The air outlet 7 is disposed at a right end portion of the outer tub 4.

The aforesaid door 4*f* is composed of a transparent or translucent heat-resistant resin or glass, and has a generally truncated cone shape. With the outer tub opening 4*a* being closed by the door 4*f*, more specifically, a conical periphery of the door 4*f* has a diameter progressively decreasing toward the rear side, and an upper portion of the conical periphery of the door 4*f* is vertically opposed to the air inlet 6 as being spaced a predetermined distance from the air inlet 6. A front edge portion of the conical periphery of the door 4*f* is bent radially outward. The bent portion of the door 4*f* is pressed against the packing 4*c* of the outer tub opening 4*a*, whereby a gap defined between the door 4*f* and the periphery of the outer tub opening 4*a* is sealed with the door 4*f* closing the outer tub opening 4*a*. Thus, the inside of the outer tub 4 is maintained in a liquid- and gas-tight state. Since the door 4*f* is translucent or transparent as described above, the laundry in the drum 5 is conveniently observed through the door 4*f*.

The drying air flowing downward from the air inlet 6 to be supplied to the outer tub opening 4*a* impinges on a portion of the conical periphery of the door 4*f* opposed to the air inlet 6. Then, a part of the drying air further flows downward along the conical periphery of the door 4*f* without being deflected, and flows into a gap 70 defined between the front wall of the outer tub 4 and a front wall of the drum 5 below the outer tub opening 4*a* (as indicated by a broken-line arrow in FIG. 3). The gap 70 has an anteroposterior dimension of, for example, about 3 mm.

The drying air supplied to the laundry in the drum 5 is heat-exchanged with the laundry as described above, and then flows out of the drum 5 through a plurality of perforations formed in the periphery of the drum 5 and into the circulation duct 8 through the air outlet 7 of the outer tub 4. However, the drying air flowing into the gap 70 is not supplied to the laundry in the drum 5, but directly flows into the circulation duct 8 through the air outlet 7. Therefore, not all the drying air supplied to the outer tub opening 4*a* from the air inlet 6 of the circulation duct 8 is used for the drying of the laundry in the drum 5. This may prevent improvement in laundry drying efficiency.

In the dry cleaner 1, however, the air guide 71 (air deflecting unit) is provided as shown in FIG. 4. The air guide 71 is configured to deflect the flow of the drying air, so that almost all the drying air supplied to the outer tub opening 4*a* from the air inlet 6 of the circulation duct 8 is directed toward the drum opening 5*a*. The air guide 71 will hereinafter be described in detail.

As shown in FIG. 5, the air guide 71 is composed of a resin, and has a generally arcuate shape. The air guide 71 integrally includes an inclined wall 72, end portions 73, intermediate walls 74 (divider walls) and a rail 75. The generally arcuate shape of the air guide 71 has substantially the same curvature radius as the outer tub opening 4*a*, and has an arc length which is a little smaller than one half the entire circumference of the outer tub opening 4*a* (see FIG. 6).

The inclined wall 72 is a generally arcuate thin plate having a radius progressively decreasing toward the rear side (toward the drum 5). The inclined wall 72 has a generally rectangular escape hole 79 provided in a right end portion thereof adjacent to one of the end portions 73 (to be described later) as extending thicknesswise through the inclined wall 72.

The end portions 73 each have a generally inverted quadrangular pyramid shape having a bottom face continuous from an upper edge of the inclined wall 72, and are respectively provided on left and right ends (longitudinally opposite ends) of the inclined wall 72. Opposed side faces of the respective end portions 73, i.e., transversely (laterally) inward faces of the respective end portions 73, respectively define end walls 76 which extend rearward from the inclined wall 72 perpendicularly to the inclined wall 72. The end portions 73 each have two end portion through-holes 77 (screw insertion holes) extending therethrough radially of the inclined wall 72.

The two intermediate walls 74 each have a generally triangular thin plate shape, and are equidistantly arranged on a longitudinally intermediate portion of the inclined wall 72. The generally triangular intermediate walls 74 each have three edges, one of which joins the inclined wall 72 as extending anteroposteriorly, another of which horizontally extends rearward continuously from an upper edge of the inclined wall 72, and the other of which vertically extends upward continuously from a lower edge of the inclined wall 72. Further, the air guide 71 has intermediate wall through-holes 78 (screw insertion holes) formed at anteroposteriorly middle positions of the intermediate walls 74 as vertically extending through the intermediate walls 74 and the inclined wall 72.

The rail 75 connects rear upper edge portions of the end portions 73 and the intermediate walls 74. The rail 75 reinforces the rigidity of the entire air guide 71.

The air guide 71 having such a structure is provided on the upper edge portion of the outer tub opening 4*a* as shown in FIG. 6 (also see FIG. 1). In this state, the inclined wall 72 extends along an upper peripheral edge portion of the outer tub opening 4*a*, and is opposed to the air inlet 6 of the circulation duct 8 from the lower side. More specifically, the inclined wall 72 is located vertically between the air inlet 6 and the upper portion of the conical periphery of the door 4*f* with the outer tub opening 4*a* being closed by the door 4*f*, and inclined downward rearward as seen from a lateral side (see FIG. 4). Since the air guide 71 is provided on the upper edge portion of the outer tub opening 4*a* as described above, the air guide 71 does not hinder the loading and unloading of the laundry in and out of the drum 5 through the drum opening 5*a* and the outer tub opening 4*a*. With the outer tub opening 4*a* being closed, the air guide 71 does not hinder the observation of the laundry in the drum 5 through the door 4*f*.

For attaching the air guide 71 to the outer tub 4, screws (not shown) are inserted through the end portion through-holes 77 of the respective end portions 73 and the intermediate wall through-holes 78 of the respective intermediate walls 74 (see FIG. 5) from a radially inner side of the inclined wall 72 and fixed to a portion of the outer tub 4 defining the outer edge portion of the outer tub opening 4*a*. Since the air guide 71 thus has the end portion through-holes 77 and the intermediate wall through-holes 78 as attachment members for attaching the air guide 71 to the outer tub 4, the number of the components can be reduced without the need for additionally providing an air guide attachment member. Further, the end portion through-holes 77 and the intermediate wall through-holes 78 provide a plurality of joint portions between the outer tub 4 and the air guide 71, so that the attitude of the air guide 71 attached to the outer tub 4 can be stabilized.

The drying air flowing downward from the air inlet 6 to be supplied to the outer tub opening 4*a* impinges on the inclined wall 72 of the air guide 71 opposed to the air inlet 6. The flow of the drying air impinging on the inclined wall 72 is deflected rearward into the drum 5 through the drum opening 5*a* (as indicated by a broken-line arrow in FIG. 4). Thus, the drying air is prevented from further flowing downward in the outer tub opening 4*a* into the gap 70 defined between the outer tub 4 and the drum 5, but the drying air flowing downward is deflected into the inner side of the drum 5 to be supplied to the laundry in the drum 5. Therefore, all the drying air is used for the drying of the laundry, thereby improving the laundry drying efficiency. The deflection of the drying air can be achieved by a simple structure, i.e., by the inclined wall 72. Further, the inclined wall 72 extends along the upper peripheral edge portion of the outer tub opening 4*a*, so that the drying air can be smoothly introduced into the drum 5 from the upper edge portion of the outer tub opening 4*a*.

More specifically, drying air having impinged on a portion of the inclined wall 72 between the intermediate walls 74 is partly deflected rearward as described above. The rest of the drying air flows longitudinally of the inclined wall 72 to impinge on the intermediate walls 74, and is guided by the intermediate walls 74 to be deflected rearward. Further, drying air having impinged on portions of the inclined wall 72 between the intermediate walls 74 and the end walls 76 is partly deflected downward as described above. The rest of the drying air flows downward longitudinally of the inclined wall 72 to impinge on the end walls 76, and is guided by the end walls 76 to be deflected rearward. That is, the drying air having impinged on the inclined wall 72 partly flows along the inclined wall 72 (longitudinally of the inclined wall 72), but impinges on the intermediate walls 74 and the end walls 76 to be deflected rearward (into the drum 5). Therefore, the drying air is reliably supplied into the drum 5, thereby improving the laundry drying efficiency.

As described above, the intermediate walls 74 partition the inclined wall 72 into a portion defined between the intermediate walls 74 and portions defined between the intermediate walls 74 and the end walls 76, so that the flow of the drying air deflected by the inclined wall 72 is divided. Without the provision of the intermediate walls 74, the drying air having impinged on the inclined wall 72 flows along the inclined wall 72 to the end walls 76 to be supplied into the drum 5. In this case, the drying air is supplied into the drum 5 from local positions of the inclined wall 72 and, therefore, unevenly applied to the laundry, making it impossible to improve the laundry drying efficiency. With the provision of the intermediate walls 74, on the contrary, the flow of the drying air on the inclined wall 72 is divided by the intermediate walls 74. Therefore, the drying air is not concentrated on the local positions of the inclined wall 72, but evenly applied to the laundry in the drum 5 from the inclined wall 72. This further improves the laundry drying efficiency.

The drying air flowing longitudinally of the inclined wall 72 toward the end walls 76 partly escapes through the escape hole 79. More specifically, the drying air having escaped through the escape hole 79 impinges on the conical periphery of the door 4*f* and flows along the conical periphery of the door 4*f* to dry the packing 4*c*. If the packing 4*c* is wet, for example, when the laundry is unloaded from the drum 5 through the outer tub opening 4*a* with the door 4*f* being opened after the completion of the drying of the laundry, the dried laundry is brought into the wet packing 4*c* to be wetted. Further, if the packing 4*c* is wetted with the solvent, a part of the dried laundry in contact with the packing 4*c* is liable to thermally react with the solvent to be discolored. However, the drying air having impinged on the inclined wall 72 partly escapes toward the packing 4*c* through the escape hole 79, so that the packing 4*c* is dried by the escaping drying air. Therefore, the laundry is free from the wetting, the discoloration and other inconveniences even if the laundry is brought into contact with the packing 4*c* when the laundry is unloaded after the completion of the drying. Since only a small fraction of the drying air escapes through the escape hole 79, there is no possibility that the drying efficiency is reduced.

As described above, the escape hole 79 is provided adjacent one of the end portions 73 in the inclined wall 72, i.e., in the lower end portion of the inclined wall 72. A lower portion of the packing 4*c* is located apart from the drying air impinging on the inclined wall 72 on the upper edge portion of the outer tub opening 4*a*. However, the drying air is partly supplied to the lower portion of the packing 4*c* through the escape hole 79 formed in the lower end portion of the inclined wall 72, thereby preventing the lower portion of the packing 4*c* from being wetted. Thus, the packing 4*c* is completely dried, so that the laundry is free from the wetting, the discoloration and other inconveniences even if the laundry is brought into contact with the packing 4*c* when the laundry is unloaded after the completion of the drying.

As described above, the inclined wall 72 is located vertically between the air inlet 6 and the upper portion of the conical periphery of the door 4*f* with the outer tub opening 4*a* being closed by the door 4*f* (see FIG. 4). Therefore, the drying air from the air inlet 6 impinges on the inclined wall 72, but is prevented from impinging on the door 4*f*. This prevents the door 4*f* from being needlessly overheated.

It should be understood that the present invention be not limited to the embodiment described above, but various modifications may be made within the purview of the appended claims.

For example, the rotation shaft of the drum 5 is not necessarily required to extend horizontally, but may be inclined at a predetermined angle (e.g., not greater than 30 degrees) with respect to a horizontal plane.

Further, the upper portion of the conical periphery of the door 4*f* (the upper edge portion of the door 4*f*) may serve the function of the inclined wall 72. That is, with the outer tub opening 4*a* being closed by the door 4*f*, the upper edge portion of the door 4*f* may be directly opposed to the lower end (the air inlet 6) of the circulation duct 8 without the intervention of the inclined wall 72. Like the inclined wall 72, the upper edge portion of the door 4*f* is inclined obliquely downward rearward as seen from a lateral side (see FIG. 4). Therefore, the drying air from the air inlet 6 impinges on the upper edge portion of the door 4*f* to be deflected into the drum 5 through the drum opening 5*a*, so that the upper edge portion of the door 4*f* has the same effect as the inclined wall 72. In this case, the drying air having impinged on the upper edge portion of the door 4*f* is liable to partly flow along the outer peripheral portion (conical periphery) of the door 4*f* including the upper edge portion. To cope with this, end walls 76 as described above may be provided on opposite sides of an area in which the air inlet 6 is opposed to the upper edge portion of the door 4*f* (see FIG. 6). This permits the drying air to partly impinge on the end walls 76 to be deflected rearward (into the drum 5). Thus, the drying air is reliably supplied into the drum 5.

This application corresponds to Japanese Patent Application No. 2006-314579 filed in the Japanese Patent Office on Nov. 21, 2006, the disclosure of which is incorporated herein by reference.

What is claimed is:

1. A laundry apparatus, comprising:

an inner tub which is rotatable about a generally horizontally-extending rotation axis, the inner tub having opposing end faces disposed along the rotation axis, and having an inner tub opening formed in one of the end faces, the inner tub being configured to contain laundry loaded therein through the inner tub opening;

an outer tub which accommodates the inner tub and has an outer tub opening provided in association with the inner tub opening;

a drying air generating unit which generates drying air for drying the laundry contained in the inner tub;

a drying air supply passage disposed above the outer tub opening and extending downward for causing the drying air generated by the drying air generating unit to flow downward to supply the drying air to the outer tub opening; and an air deflecting unit provided on an upper edge portion of the outer tub opening and being opposed to a lower end of the drying air supply passage for deflecting a flow of the drying air supplied to the outer tub opening, to direct the flow of the drying air into the inner tub through the inner tub opening, the air deflecting unit including:

an inclined wall on which the drying air flowing downward impinges to be deflected into the inner tub, the inclined wall extending along an upper peripheral edge portion of the outer tub opening;

end walls that are respectively provided on longitudinally opposite ends of the inclined wall, and;

a divider wall provided on a longitudinally intermediate portion of the inclined wall for dividing the flow of the drying air deflected by the inclined wall.

2. A laundry apparatus, comprising:

an inner tub which is rotatable about a generally horizontally-extending rotation axis, the inner tub having opposing end faces disposed along the rotation axis, and having an inner tub opening formed in one of the end faces, the inner tub being configured to contain laundry loaded therein through the inner tub opening:

an outer tub which accommodates the inner tub and has an outer tub opening provided in association with the inner tub opening;

a drying air generating unit which generates drying air for drying the laundry contained in the inner tub;

a drying air supply passage disposed above the outer tub opening and extending downward for causing the drying air generated by the drying air generating unit to flow downward to supply the drying air to the outer tub opening;

an air deflecting unit provided on an upper edge portion of the outer tub opening and being opposed to a lower end of the drying air supply passage for deflecting a flow of the drying air supplied to the outer tub opening, to direct the flow of the drying air into the inner tub through the inner tub opening, the air deflecting unit including an inclined wall on which the drying air flowing downward impinges to be deflected into the inner tub;

a door provided for opening and closing the outer tub opening; and a packing which seals a gap defined between the door and a peripheral edge of the outer tub opening when the door closes the outer tub opening;

wherein the inclined wall has an escape hole which permits the drying air to partly escape toward the packing.

3. The laundry apparatus according to claim 2, wherein the escape hole is provided in a lower end portion of the inclined wall.

4. The laundry apparatus according to claim 2, wherein the door has a translucent or transparent portion which covers the outer tub opening when the outer tub opening is closed by the door.

5. The laundry apparatus according to claim 2, wherein the inclined wall extends along an upper peripheral edge portion of the outer tub opening, and end walls are respectively provided on longitudinally opposite ends of the inclined wall.

6. The laundry apparatus according to claim 5, wherein a divider wall is provided on a longitudinally intermediate portion of the inclined wall for dividing the flow of the drying air deflected by the inclined wall.

7. The laundry apparatus according to claim 6, wherein the air deflecting unit includes an attachment member for attaching the air deflecting unit to the outer tub.

8. The laundry apparatus according to claim 7, wherein the attachment member includes screw insertion holes respectively provided in the divider wall and portions of the air deflecting unit longitudinally outward of the end walls.

* * * * *